US006112723A

United States Patent [19]

Itoyama et al.

[11] Patent Number: 6,112,723

[45] Date of Patent: Sep. 5, 2000

[54] ACTIVATION CONTROL DEVICE FOR AN INTERNAL COMBUSTION ENGINE

[75] Inventors: Hiroyuki Itoyama; Takashi Tsuneyoshi; Minoru Arimitsu; Shojiro Sato, all of Yokohama, Japan

[73] Assignee: Nissan Motor Co., Ltd., Yokohama, Japan

[21] Appl. No.: 09/201,259

[22] Filed: Nov. 30, 1998

[30] Foreign Application Priority Data

Dec. 5, 1997 [JP] Japan ..... 9-335864

[51] Int. Cl.[7] ..... F02D 41/06

[52] U.S. Cl. ..... 123/491

[58] Field of Search ..... 123/479, 491, 123/179.16

[56] References Cited

U.S. PATENT DOCUMENTS 5,447,143 9/1995 Ott et al. ..... 123/612

5,595,161 1/1997 Ott et al. ..... 123/491

FOREIGN PATENT DOCUMENTS 7-83093 3/1995 Japan .

*Primary Examiner*—Tony M. Argenbright

*Attorney, Agent, or Firm*—Foley & Lardner

[57] ABSTRACT

Even when an engine rotates in the inverse direction immediately before stopping, the engine can be accurately activated. In an engine which injects fuel sequentially on the basis of an ignition order of each cylinder, a crank angle of the terminal position of the engine is stored. On the first fuel injection timing after engine activation, fuel is simultaneously injected into a cylinder which is determined from the terminal stored position and into a cylinder in a fixed positional relationship with the first cylinder. In this way, even when an engine rotates in the inverse direction immediately before stopping, fuel injection can be accurately performed at least on a cylinder into which fuel should be injected and the engine can be accurately activated.

9 Claims, 6 Drawing Sheets

ACTIVATION CONTROL DEVICE FOR AN INTERNAL COMBUSTION ENGINE

FIELD OF THE INVENTION

The present invention relates to an activation control device for an internal combustion engine which sequentially injects fuel into each cylinder.

BACKGROUND OF THE INVENTION

An engine which performs sequential injection, that is to say, an engine in which the injection period of fuel into each cylinder of an engine is controlled depending on the operational timing of each cylinder is known in the art. An activation control device which initially sequentially injects fuel from the time the engine is activated is disclosed in JP-A-7-83093.

In this invention, the terminal crank angle of the engine is stored based on a standard crank angle signal of the engine (for example a standard signal of each 90° sector for a 4 cylinder engine). Then on the next occasion the engine is activated, the first cylinder into which fuel is injected is decided on the basis of the stored value of the crank angle and sequential injection is performed.

However when the engine is stopped, it sometimes rotates at one point in the inverse direction before stopping. However in the above activation control device, when the engine rotates at one point in the inverse direction before stopping, the actual crank angle terminal position differs from the crank angle position as stored. Thus the problem has arisen that when the first cylinder into which fuel is injected when the engine is reactivated is decided on the basis of that stored value, if the engine has rotated at one point in the inverse direction before stopping, fuel injection will not be performed on the correct cylinder and activation can not be performed smoothly.

SUMMARY OF THE INVENTION

The object of the present invention is to accurately activate an engine when the engine has rotated at one point in the inverse direction before stopping.

To achieve the above object the invention provides an activation control device in an engine with a plurality of cylinders where the engine comprises an injector which injects fuel individually into the air intake port of each the cylinder, a sensor which detects a standard position signal of a crank angle corresponding to the cylinder, a memory which stores a terminal position of the engine on the basis of the standard position signal, and a microprocessor which is programmed to decide the cylinder into which fuel should be injected on the activation of the engine based on the stored terminal position and to control a fuel injection timing of each cylinder sequentially based on the standard position signal.

The microprocessor is further programmed, on the first fuel injection timing when the engine is activated, to control simultaneous injection of fuel into the cylinder into which fuel injection should be performed as determined from the stored terminal position and into a cylinder in a fixed positional relationship with the first cylinder.

DESCRIPTION OF THE PREFERRED EMBODIMENTS

The embodiments will be described as adapted to a 4 cycle cylinder gasoline engine.

Figure 1:
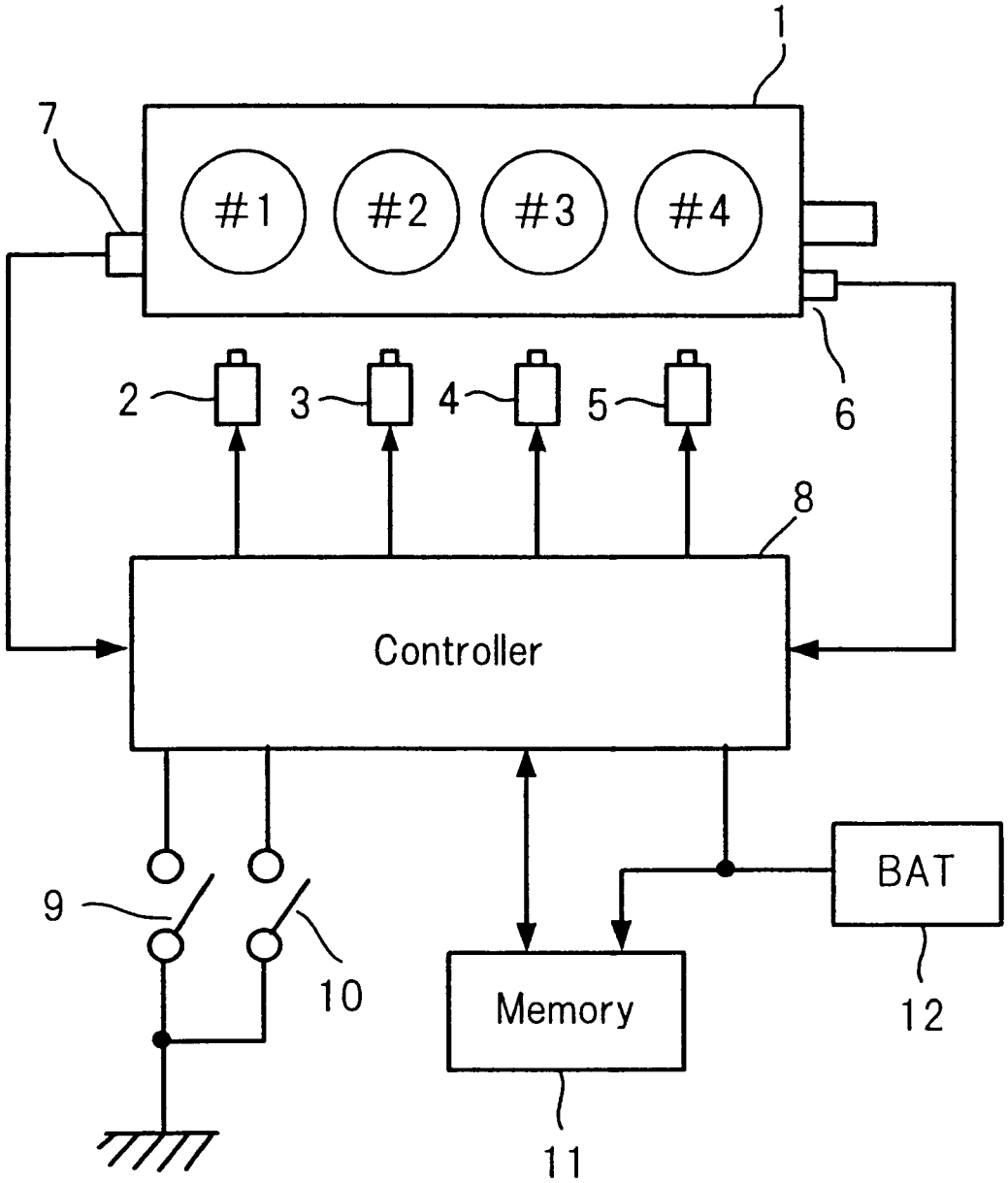
FIG. 1 shows the layout of an embodiment of the present invention.

In FIG. 1, fuel is injected from fuel injectors 2, 3, 4, 5, provided respectively in the air inlet ports in the four cylinders #1–#4 of the engine 1.

A controller 8 is provided comprised of a microcomputer and related component parts in order to control the injected amount and injection timing of each fuel injector and the ignition timing.

Signals from the crank angle sensor 6 are input into the controller 8. The crank angle sensor 6 generates pulse signals (hereafter called REF signals) when each cylinder piston passes a standard position for example, as discussed below, a fixed position before the compression top dead point. This standard position signal is used to set ignition timing and fuel injection timing.

A signal from the water temperature sensor 7 which detects the temperature of the engine cooling water is input into the controller 8. Furthermore signals from the ignition switch 9 and the start switch 10 are also input. A memory 11 which stores a standard crank angle position when the engine is stopped and a battery 12 which acts as a source of electricity are connected.

The ignition switch 9 is in the "on" position when the ignition key is in the START or the ON position. The start switch 10 is in the "on" position when the ignition key is in the START position.

The relationship between the REF signal and sequential fuel injection for each engine cylinder will be explained below with reference to FIG. 2.

In this embodiment, an engine 1 performs ignition in the order #1→#3→#4→#2 using the REF signal as a standard. The REF signal is output at the crank angle 15° before the top compression dead point of each cylinder. Only the first cylinder #1 has a wide 6° pulse crank angle. As is clear from the drawings, the fuel injection to each cylinder is performed immediately after the input of two REF signals after the input of the REF signal from that cylinder. For example the fuel injection to the #1 cylinder is performed immediately after two REF signals, that is to say, immediately after the #4 cylinder REF signal is input after the REF signal from the #1 cylinder is input. In the discussion below, the #1 cylinder–#4 cylinder REF signals are respectively referred to as simply #1REF signal–#4 REF signals.

Since the wide pulse REF signal corresponds to the #1 cylinder, if a wide pulse signal is input, it is confirmed that the piston of the cylinder #1 has passed the 15° crank angle position before the top compression dead point. Since however, all other REF signals are short, it is not possible to distinguish which REF signal corresponds to which cylinder by merely detecting a REF signal. As a result, REF signals corresponding to respective cylinder are determined by counting the number of REF signals input after the wide pulse REF signal is input.

This embodiment takes the example of the wide pulse signal corresponding to the #1 cylinder. However it is possible for the wide pulse REF signal to correspond to cylinders other than the #1 cylinder.

Next the control of fuel injection when the engine is activated will be explained.

In this invention, the terminal position of the engine is stored on the basis of the REF signal from the crank angle sensor 6. When the engine is reactivated, a basic amount of fuel is injected simultaneously into a total of the two cylinders comprising the cylinder into which fuel should be first injected as understood from the stored terminal position of the engine and the cylinder which is two cylinders before the first one in ignition order. Below, the necessary basic amount of fuel injected into the cylinder when the engine is activated is termed basic fuel injection and the injection of an amount of fuel less than the basic amount of fuel is termed supplementary fuel injection.

Figure 3:
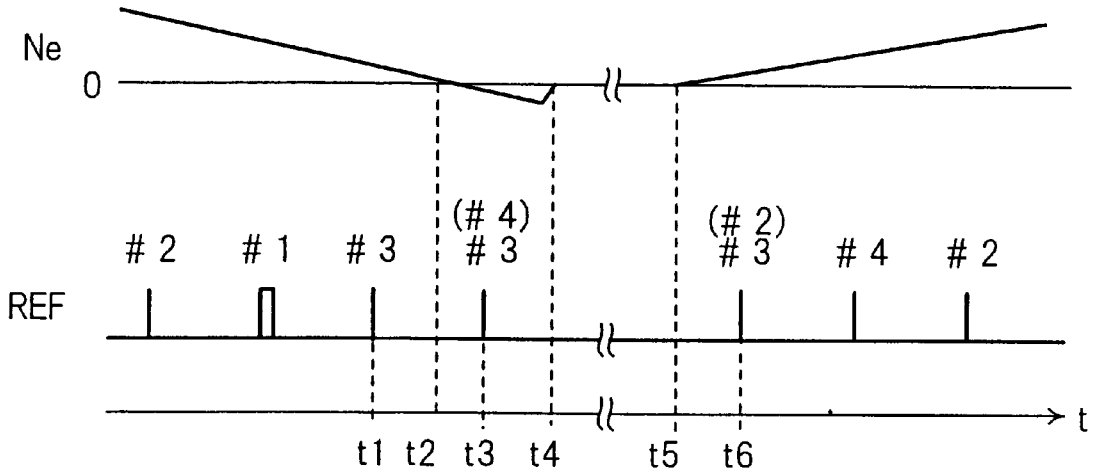
FIG. 3 shows the relationship of a REF signal and engine rotation speed Ne when an engine is activated and stopped when the engine has rotated in the inverse direction before stopping.
Figure 4:
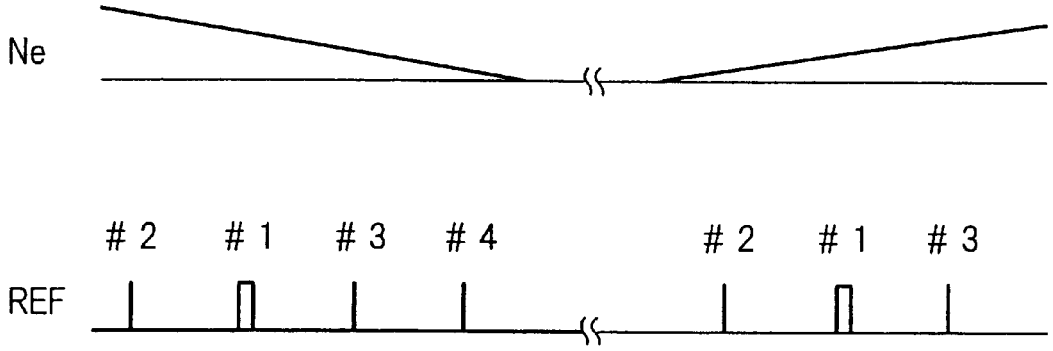
FIG. 4 shows the relationship between a REF signal and engine rotation speed Ne when an engine is activated and stopped when the engine has not rotated in the inverse direction before stopping.

FIGS. 3 and 4 shows the relationship between the engine rotation speed Ne and REF signal when the engine is stopped and reactivated.

FIG. 3 shows the engine when rotating in the inverse direction after stopping and FIG. 4 shows no inverse rotation after stopping.

As shown in FIG. 3, when the engine stops, #3 REF signal is input at time t1. At time t2, after the rotation speed of the engine Ne has reached zero at one point, the engine rotates in the inverse direction and another REF signal is input at time t3. After this, the engine stops at time t4. Since the input of the #3 REF signal at time t1 immediately before the inverse rotation has been detected, the #3 REF signal, input a second time when the engine rotates in the inverse direction at time t3, is mistaken for #4 REF signal which is the signal next in order to the #3 REF signal. Hence the terminal position of the engine is stored as between #4 REF signal and #2 REF signal.

Due to the connection phase of the piston with respect to the crank shaft, even if inverse rotation occurs, normally it will be of the order of one cylinder. Inverse rotation of more than two cylinders does not occur.

When the engine is activated at time t5, #3 REF signal is input a second time at time t6 because the engine rotates normally. However since the terminal position before reactivation has been stored as being between #4 REF and #2 REF, #3 REF signal is mistaken for #2 REF signal.

When the engine does not rotate in the inverse direction on stopping, as shown in FIG. 4, since the engine has stopped after the input of #4 REF signal immediately before termination is detected, the terminal position is stored as being between #4 REF and #2 REF.

In this case, when the engine is reactivated, it is possible to correctly confirm the first input REF signal as #2 REF signal based on the terminal stored position of the engine.

As shown by either FIG. 3 or FIG. 4, the terminal stored position of the engine is between #4 REF and #2 REF.

However actually, the terminal position in FIG. 3 where the engine has rotated in the inverse direction, only differs from that in FIG. 4 where the engine has not rotated, by two cylinders in ignition order, that is to say, by a crank angle of 360° (one rotation). Namely the terminal position, when the engine has rotated in the inverse direction on stopping, is only a crank angle of 360° (one rotation) ahead of the terminal position when the engine does not rotate in the inverse direction.

The first cylinder into which fuel is injected after the engine is activated is determined on the basis of the terminal engine position stored in the memory 11. A basic fuel amount is simultaneously injected into that cylinder and the cylinder two cylinders before it in ignition order.

Figure 2:
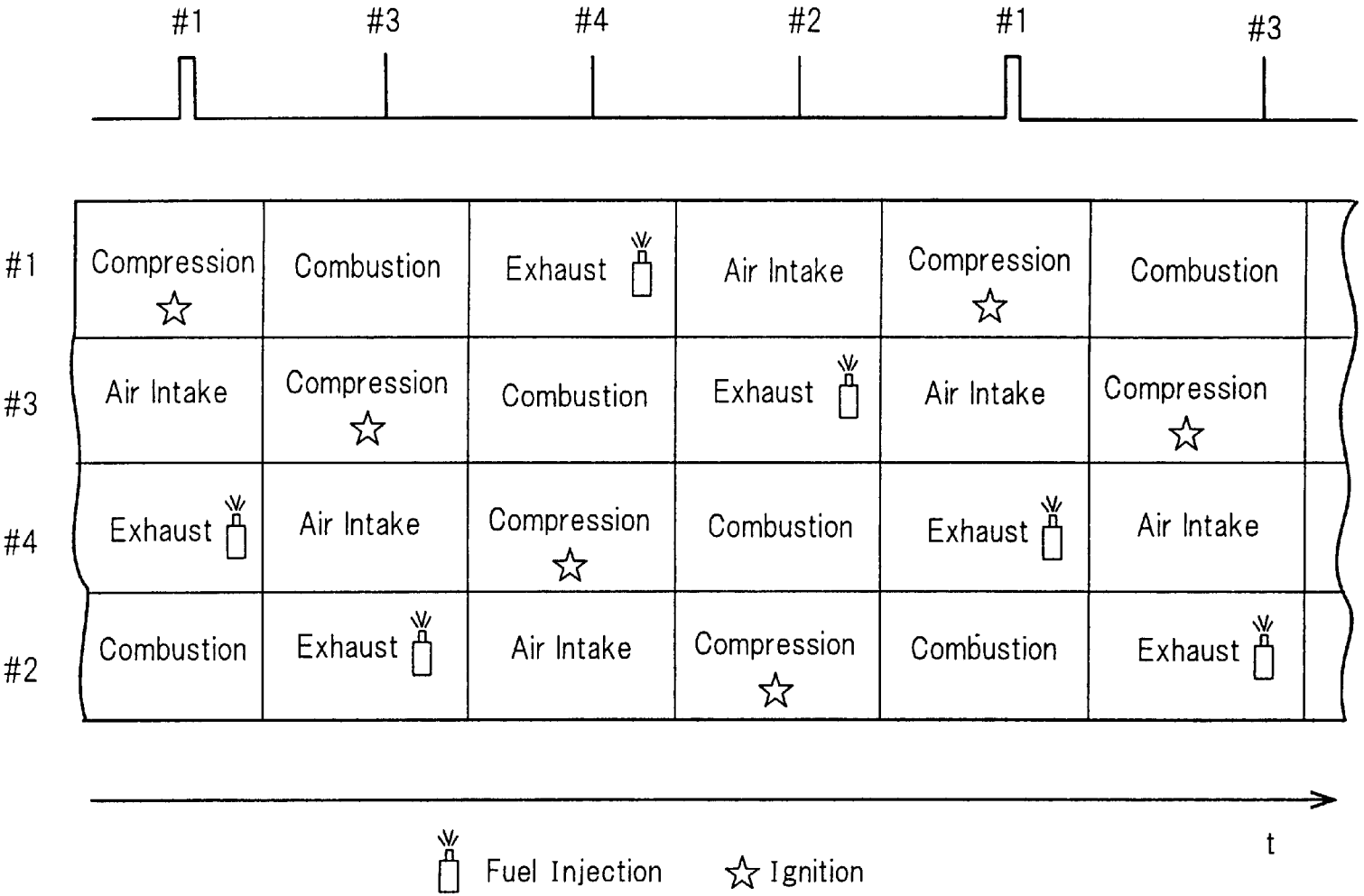
FIG. 2 shows the relationship of a REF signal of a 4 cycle engine and the fuel injection period.

For example in FIGS. 3 and 4, in either case since the first REF signal after the engine is activated is determined to be the #2 cylinder REF signal, as shown in the case of FIG. 2, when the REF signal for #2 cylinder is generated, fuel is injected into #3 cylinder which is in the later half of the exhaust stroke and requires fuel injection and simultaneously into #2 cylinder which is the cylinder two cylinders ahead of #3 cylinder in the ignition order.

When the engine has rotated in the inverse direction, the #3 cylinder is actually the cylinder into which fuel should be injected corresponding to the first REF signal after the reactivation of the engine as shown in FIG. 3. Furthermore when no inverse rotation has taken place, the #2 cylinder is the cylinder into which fuel should be injected corresponding to the first REF signal when the engine is reactivated as shown in FIG. 4. Hence one of the two cylinders into which fuel is injected simultaneously must be a correct cylinder for fuel injection. As a result, the engine can be accurately activated without being limited by the presence of absence of inverse rotation when the engine stops.

This activation fuel control continues until the first wide pulse #1 REF signal is input after activation. This is because it is not possible to confirm an accurate cylinder position until the input of the wide pulse #1 REF signal.

Thus after initial fuel injection on engine activation, when the wide pulse #1 REF signal is input, normal sequential injection is immediately initiated as it is possible to accurately confirm the present position of the engine based on the #1 REF signal.

In contrast, after initial fuel injection on engine activation, when there is no wide pulse #1 REF signal and another REF signal for another signal is input, since the position of the cylinder at that time can not be accurately confirmed, normal sequential injection can not immediately be initiated. In this event, when initial fuel injection is performed, basic fuel injection is carried out simultaneously, in the same manner as the first time, on the next cylinder in ignition order and the cylinder two cylinders before that cylinder in ignition order based on the first cylinder which was fuel injected.

Figure 5:
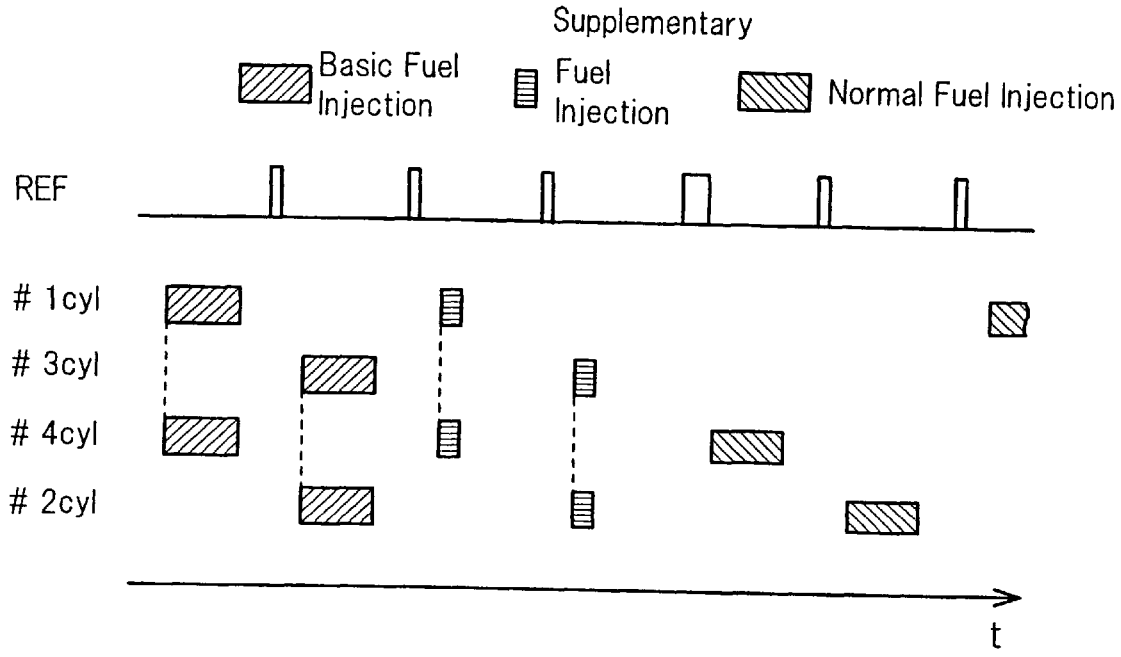
FIG. 5 shows the amount of fuel injected and the cylinder into which fuel is injected after engine activation.

For example as shown in FIG. 5, after the first fuel injection on engine activation, #4 cylinder and #1 cylinder, which is the cylinder two cylinders before #4 in ignition order, are simultaneously injected with fuel.

Then the next cylinder in ignition order after #4 cylinder on the input timing of the next REF signal is #2 cylinder. Thus #2 cylinder and #3 cylinder which is the cylinder two cylinders before #2 cylinder in ignition order undergo fuel injection. That is to say, after engine activation, basic fuel injection is performed simultaneously on groups of two cylinders on two consecutive occasions according to the ignition order until a #1 REF signal is input and the cylinders are distinguished. In this way even when there has been inverse rotation, correct combustion operation is maintained. Then when a #1 REF signal is input, normal sequential injection can be initiated.

However after basic fuel injection is performed simultaneously on groups of two cylinders on two consecutive occasions and a #1 REF signal has not been input, as shown in FIG. 5, either supplementary injection is performed simultaneously on groups of two cylinders on two consecutive occasions or fuel injection is terminated. Since all four cylinders are injected with fuel after activation by this method of injecting fuel on two occasions, even if fuel injection is terminated after this, if each cylinder is in ignition order, the fuel that has been injected into the respective air intake port beforehand is sucked into that cylinder and correct operation is ensured. Therefore unnecessary fuel injection is avoided. Then normal sequential fuel injection is performed after waiting for the input of a #1 REF signal.

Furthermore if limited supplementary fuel injection is performed after the double consecutive fuel injection, the injected fuel that is residing in the air inlet port ensures the necessary air/fuel ratio even if there is a delay when the fuel is drawn into the cylinder on the inspiration stroke. Thus stable combustion is ensured.

To summarize the fuel injection method shown above, fuel injection timing performed by REF signals after engine activation comprises firstly basic fuel injection which is performed on groups of two cylinders on two consecutive occasions and then either supplementary fuel injection on groups of two cylinders on two consecutive occasions or the termination of fuel injection. In this way it is possible to supply fuel certainly to all four cylinders while waiting for the input of the first #1 REF signal after activation and thus activation is smoothly performed.

The above embodiment was explained on the basis of a 4 cylinder engine. However generally fuel injection order after engine activation of an engine of N cylinders (where N is the number of cylinders) is performed as below. In other words, fuel injection timing on the basis of REF signals comprises firstly basic fuel injection which is performed on groups of two cylinders on (N/2) consecutive occasions and then either supplementary fuel injection on groups of two cylinders on (N/2) consecutive occasions or the termination of fuel injection. For example, if a six cylinder engine is under consideration, basic fuel injection is performed on groups of two cylinders on three consecutive occasions (in this way all six cylinders undergo fuel injection), then after these three repetitions, supplementary fuel injection or fuel injection termination is performed. In the case of an eight cylinder engine, basic fuel injection is performed on groups of two cylinders on four consecutive occasions (in this way all eight cylinders undergo fuel injection), then after these four repetitions, supplementary fuel injection or fuel injection termination is performed.

However as shown above if a #1 REF signal is input while the above routine is being performed, activation control is immediately terminated and normal sequential fuel injection is carried out from that point.

Figure 6:
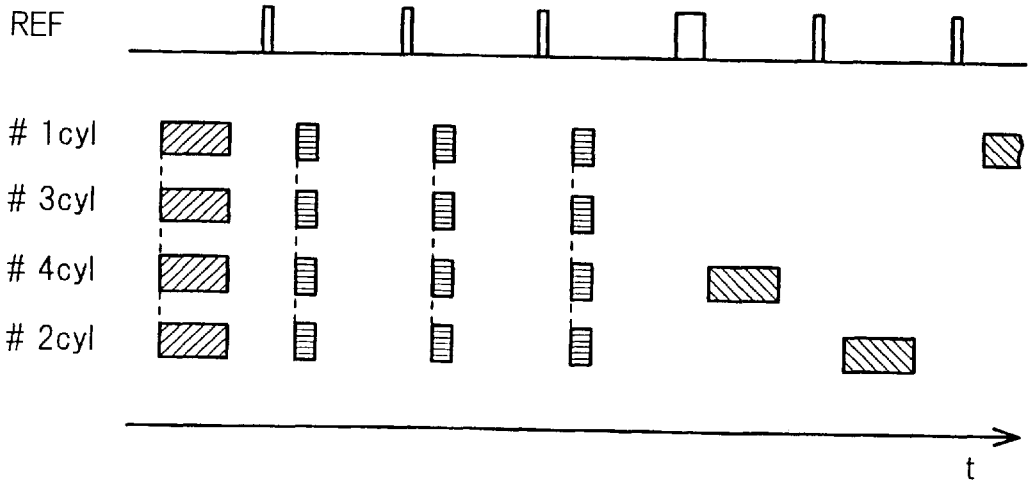
FIG. 6 shows the amount of fuel injected and the cylinder into which fuel is injected after engine activation when there is an abnormality in the control device or the first activation.

However when the battery 12 is replaced, the electricity supply to the memory 11 is terminated and stored information about terminal engine positions is lost. In this case, if the start switch is a closed circuit as shown in FIG. 6, basic fuel injection is immediately performed on all four cylinders. After this, until the engine rotates twice, the fuel injection timing of each cylinder is performed on the basis of supplementary fuel injection on all cylinders or the termination of fuel injection. After activation, when the engine rotates twice, since all cylinders undergo ignition in a four cylinder engine, a #1 REF signal will certainly be input in that period. Once the #1 REF signal has been input, normal sequential fuel injection is activated.

The amount of fuel injected into each cylinder is calculated as set out below.

The fuel injection period (pulse width) of the injectors 2–5 of each cylinder is determined by the following formula.

$$Ti=Tp.Tfa.\alpha+Ts$$

In the above formula, Tp is the basic fuel injection period. The engine cooling water temperature is calculated by referring to a preset map on engine activation. Tf/a is the target equivalence ratio and, at basic fuel injection when the engine is activated, it is set for example to 1.0 and supplementary fuel injection is set smaller at for example 0.1. $\alpha$ is the air/fuel ratio correction coefficient. Ts is the period for compensating for the operational delay of the injector.

Figure 7:
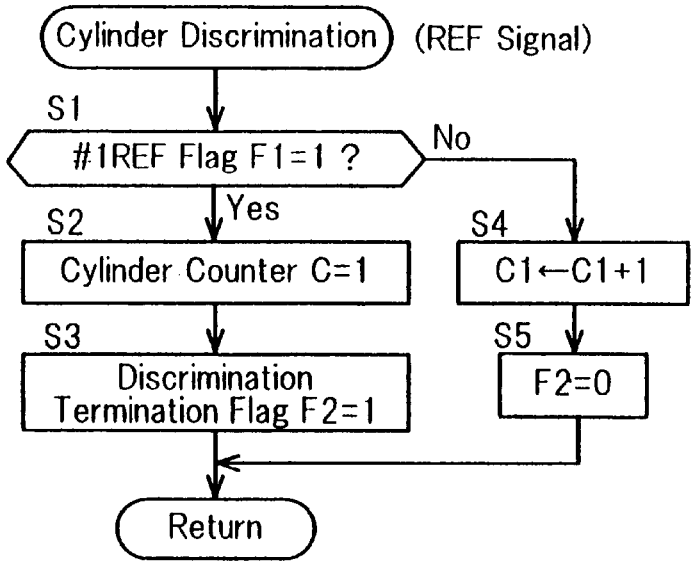
FIG. 7 is a flowchart showing the cylinder discrimination routine.
Figure 8:
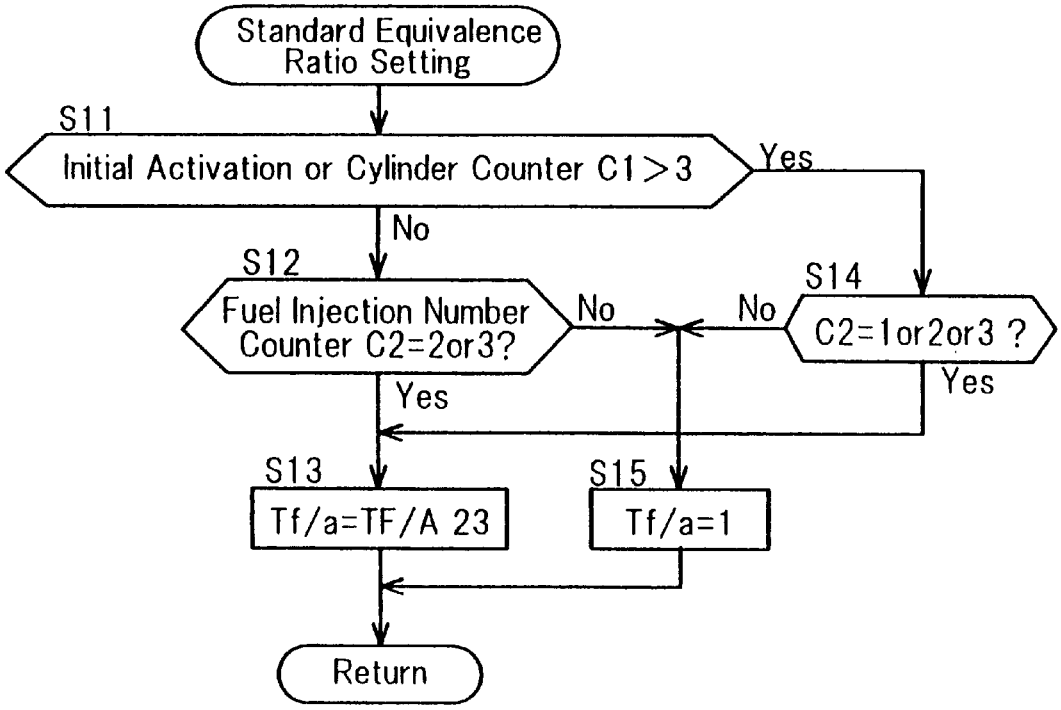
FIG. 8 is a flowchart showing a routine for setting a target equivalence.
Figure 9:
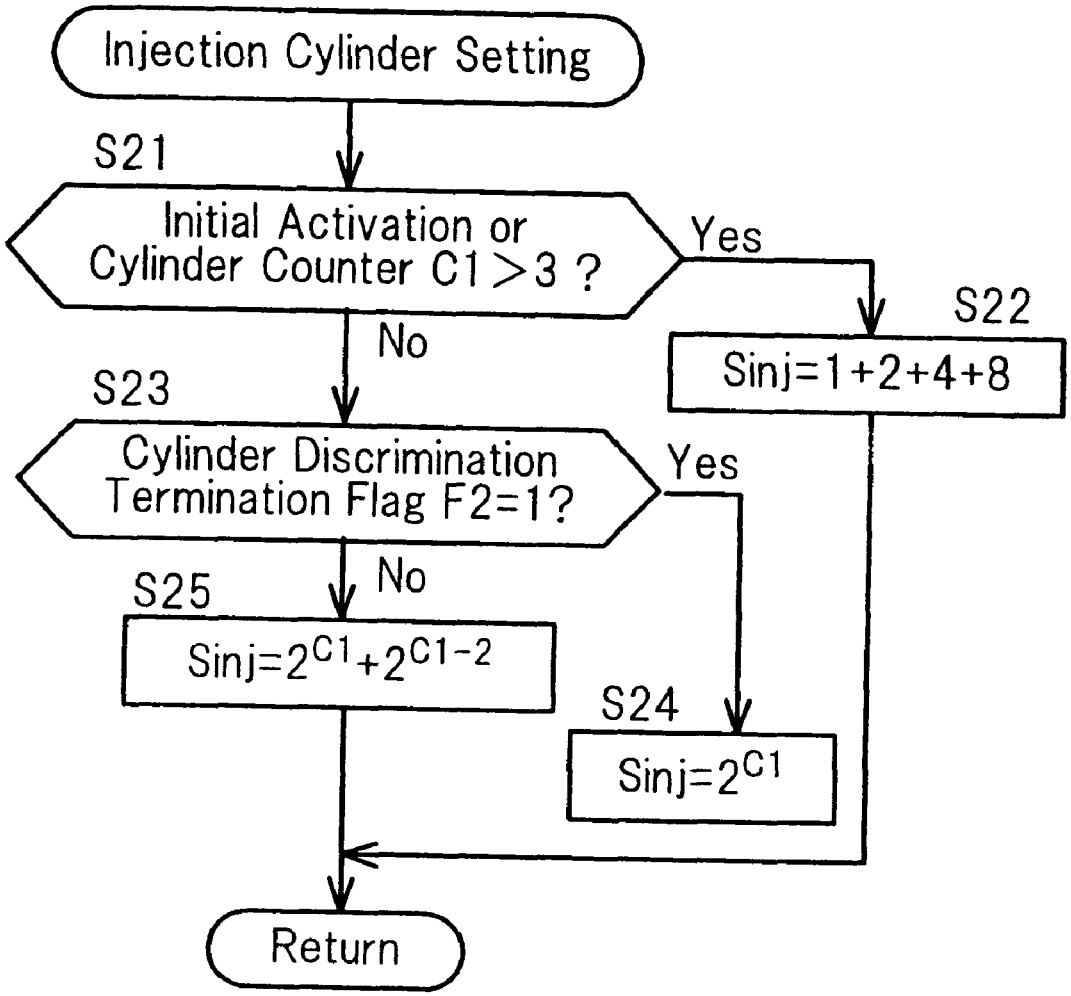
FIG. 9 is a flowchart showing the routine for setting the fuel injection cylinder.

FIG. 7–FIG. 9 are flowcharts showing the above activation control program of the engine. The present invention will be described in greater detail.

FIG. 7 is a flowchart showing the routine of cylinder discrimination.

The controller 8 performs the routine of cylinder discrimination shown in FIG. 7 each time a REF signal is received from the crank angle sensor 6.

First in a step 1, the #1 REF flag is confirmed. The #1 REF flag is set (#1 REF flag=1) if the pulse width of the REF signal is above a set crank angle, that is to say, if it is a wide pulse. In this embodiment as above, if the wide pulse REF signal is 6° above the crank angle, the flag F1 is set to F1=1 as a #1 REF signal.

When the #1 REF flag F1 is set, the routine proceeds onto a step 2 in which the cylinder counter C1, which was set on the battery backup memory, is cleared. When the #1 REF flag F1 is set, since cylinder discrimination with reference to the REF signal is possible, the cylinder discrimination completion flag F2 of a subsequent step 3 completes the process on setting F2=1.

When the #1 REF flag F1 in the step 1 is not set, the routine proceeds to a step 4. The cylinder counter C1 is incremented and the process is completed by the clearing of the cylinder discrimination flag F2 in a subsequent step 5.

The cylinder counter C1 is for the purpose of discriminating cylinders and the respective input signals of C1=0 #1REF signal, C1=1#3REF signal, C1=2 #4REF signal, C1=3 #2REF signal are displayed.

FIG. 8 is a flowchart which shows the target equivalence ratio setting routine for deciding the injected fuel amount in basic fuel injection and supplementary fuel injection.

The controller 8 performs the equivalence ratio setting routine shown in FIG. 8 each time a REF signal is received from the crank angle sensor 6.

In a step 11, it is decided whether or not to activate a first time or increase the value of the cylinder counter C1. The term "activate a first time" means the first activation after stored information on the memory 11 has been erased due to disconnection of the battery during battery replacement. Furthermore when the cylinder counter C1 has a value greater than 3, it is decided whether there has been a count malfunction or that an abnormal value has been stored when the battery was replaced. During the first activation or when an abnormal value has been stored, the routine proceeds to a step 14. If this is not the case, the routine proceeds to a step 12.

If the battery is not replaced and the counter C1 is normal, in a step 12, it is confirmed whether the count value of the counter C2 which counts the fuel injection number is 2 or 3. The counter C2 of the fuel injection number is initialized so that activation time=0.

In this embodiment, fuel injection timing by REF signals after engine activation comprises firstly performing basic fuel injection on groups of two cylinders on two consecutive occasions then supplementary fuel injection is performed on groups of two cylinders on two consecutive occasions or fuel injection is terminated. Therefore since fuel injection is already terminated when fuel injection number after activation has reached two or three times, the routine proceeds to a step 13, a set value TF/A23 is set for a reduced fuel injection amount on supplementary fuel injection as a target equivalence ratio Tf/a. The set value TF/A23 is set for a reduced fuel injection amount is set to less than 1, for example, 0.1. On the other hand, when the fuel injection number is 1 or 2 or above 5 times, the routine proceeds to a step 15 where an equivalence ratio 1 on basic fuel injection is set as the target equivalent ratio Tf/a. The fuel injection number counter C2 counts the increasing number of fuel injection after engine activation by the hardware.

In the step 11, when it is determined whether battery replacement has taken place or that the counter C1 is abnormal, in a step 14, it is confirmed whether the value of the counter C2 for fuel injection number is 2 or 3.

Since it is absolutely impossible to determine which cylinder should be fuel injected on the first fuel injection after activation when the battery has been replaced and stored information in the memory 11 has been lost, fuel injection timing due to the first REF signal firstly performs basic fuel injection simultaneously into all cylinders and then either performs supplementary fuel injection on all cylinders on three consecutive occasions or terminates fuel injection. In this way, fuel is injected into all cylinders and it is possible for activation to be accurately performed. After this, each cylinder is certainly supplied with fuel at least until the engine undergoes two rotations (therefore until a #1 REF signal is input).

Therefore supplementary fuel injection is represented when the counter 2 has a value of any of 1, 2 or 3 and the routine proceeds to a step 13 where a set value TF/A23 is set for a reduced fuel injection amount as a target equivalence ratio Tf/a. On the other hand, when the counter 2 does not have a value of any of 1, 2 or 3, it is decided that it is an initial fuel injection that is to say basic fuel injection and the routine proceeds to a step 15 where an equivalence ratio (=1) on basic fuel injection is set to the target equivalence ratio Tf/a.

FIG. 9 is a flowchart showing a setting routine of a fuel injection cylinder.

The controller 8 performs the sub-routine when a REF signal is received from a crank angle sensor 6.

Firstly in the Table 1 below, the corresponding relationship of the fuel injection cylinder setting (selection) parameter Sin j and the actual cylinder into which fuel injection is performed is shown. The parameter Sin j is calculated as set out below. In the table, for example when a value of Sin j=5 represents fuel injection into #1, #4 cylinders.

In a step 21, it is confirmed whether it is a first activation or whether the count value of the cylinder counter C1 is greater than 3. When first activation is performed after battery replacement, or when there is an abnormal cylinder count C1, the routine proceeds to a step 22 where (1+2+4+8) that is to say 15 is set as the parameter Sin j for setting (selecting) the fuel injection cylinder.

The parameter Sin j is set to 15 on the first fuel injection on the first activation and simultaneous fuel injection is performed on all cylinders #1–#4.

On the other hand, when there is no battery replacement and the cylinder counter is normal, the routine proceeds to a step 23 where it is confirmed whether the cylinder discrimination operation due to the cylinder discrimination termination flag F2 is completed or not. When the cylinder discrimination operation is completed and the flag F2=1 is set, the routine proceeds to a step 24 where the fuel injection cylinder setting parameter Sin j is calculated according to the following formula:

$$\text{Sin } j=2^{C1} \tag{1}$$

Furthermore when the flag F2 is cleared and the cylinder discrimination operation is not complete, the routine proceeds to a step 25 and at this time, the fuel injection cylinder setting parameter Sin j is calculated by the following formula, $$\text{Sin } j=2^{C1}+2^{C1-2} \tag{2}$$

In the above formula, (C1−2) represents a second value of the counter value C1 in the cylinder counter C1.

Thus when cylinder discrimination is not complete, in the period until normal sequential fuel injection is initiated after activation, injection cylinders are set using the above formula (2) so that fuel injection timing due to REF signals after engine activation is performed firstly by performing basic injection on groups of two cylinders on two consecutive occasions and then performing supplementary fuel injection on groups of two cylinders on two consecutive occasions (or terminating fuel injection).

For example, when C1=0, Sin j=$2^0+2^2$=5 and as can be understood from the table below, #1, #4 cylinders are simultaneously fuel injected. However as stated above, C1 is the value which varies in order from 0 to 3 and C1=0, 1, 2, 3.

Furthermore when C1=1, Sin j=$2^1+2^3$=10 and #2, #3 cylinders are simultaneously fuel injected.

In contrast, when the cylinder discrimination operation is terminated, that is to say, when the sequential fuel injection is initiated, the fuel injected cylinders are set using the formula (1) above so that fuel is injected into each cylinder.

For example, when C1=0, Sin j=$2^0$=1 and #4 cylinder is fuel injected. When C=1, Sin j=$2^1$=2 and #2 cylinder is fuel injected. Below where C1=2, Sin j=$2^2$=4 and #1 cylinder is fuel injected and where C1=3, Sin j=$2^3$=8 and #3 cylinder is fuel injected.

Chart 1

| S inj | Fuel injection cylinder |
|---|---|
| 1 | #4 |
| 2 | #2 |
| 4 | #1 |
| 5 | #1, #4 |
| 8 | #3 |
| 10 | #2, #3 |
| 15 | #1, #2, #3, #4 |

The above embodiment took a 4 cylinder engine with an ignition order of #1→#3→#4→#2 as an example. However the present invention can equally be adapted to a 4 cylinder engine with an ignition order of #1→#2→#4→#3.

Furthermore it is obvious that the present invention can be adapted in the same way not only to 4 cylinder engines but also to 6 cylinder engines or 8 cylinder engines.

Also the above embodiment took an example of the terminal position of the engine based on the crank angle sensor being stored in the memory. However the cylinder number at engine termination may equally be stored.

What is claimed is:

1. An activation control device in an engine with a plurality of cylinders where said engine comprises:

an injector which injects fuel individually into the air intake port of each of said cylinders;

a sensor which detects a standard position signal of a crank angle corresponding to each of said cylinders;

a memory which stores a terminal position of said engine on the basis of said standard position signal; and a microprocessor which is programmed to decide a first cylinder into which fuel should be injected on the activation of said engine based on said stored terminal position and to control a fuel injection timing of each of said cylinders sequentially based on said standard position signal wherein said microprocessor is further programmed, on the first fuel injection timing when said engine is activated, to control simultaneous injection of fuel into said first cylinder into which fuel injection should be performed as determined from the stored terminal position and into a cylinder in a fixed positional relationship with said first cylinder.

2. An activation control device as defined in claim 1 wherein said microprocessor is further programmed, on the first fuel injection timing when said engine is activated, to control simultaneous injection of fuel into said first cylinder into which fuel injection should be performed as determined from the stored terminal position and into a cylinder two cylinders ahead of said first cylinder in ignition order.

3. An activation control device as defined in claim 2 wherein said microprocessor is further programmed with respect to an engine having N number of cylinders, to control simultaneous fuel injection of fuel into a cylinder into which fuel injection should be performed as determined based on ignition order and into a cylinder two cylinders ahead of said cylinder on (N/2−1) occasions following on the first simultaneous fuel injection on two cylinders.

4. An activation control device as defined in claim 3 wherein said microprocessor is further programmed, after fuel injection on groups of two cylinders has been performed on (N/2) occasions on activation of said engine, to control fuel injection of fuel into a cylinder into which fuel injection should be performed as determined based on ignition order on (N/2) further occasions and into a cylinder two cylinders ahead of said cylinder with a smaller amount of fuel than on the first (N/2) occasions of fuel injection.

5. An activation control device as defined in claim 4 wherein said standard position signal contains a standard position signal showing a specific cylinder and said microprocessor is further programmed to terminate said activation control and perform fuel injection on each cylinder based on the ignition order of said cylinders when a standard position signal showing said specific cylinder is input.

6. An activation control device as defined in claim 1 wherein said microprocessor is further programmed, when a terminal position of said engine is stored in said memory or when an abnormal terminal position is stored, to inject fuel simultaneously into all cylinders on the first fuel injection timing after engine activation and then to inject a smaller amount of fuel into all cylinders than on the first occasion on which fuel is injected in each fuel injection timing until said engine rotates twice.

7. An activation control device in an engine with a plurality of cylinders where said engine comprises:

an injector which injects fuel individually into the air intake port of each of said cylinders;

a sensor which detects a standard position signal of a crank angle corresponding to each of said cylinders;

a memory which stores a terminal position of said engine on the basis of said standard position signal; and a microprocessor which is programmed to decide a first cylinder into which fuel should be injected on the activation of said engine based on said stored terminal position and to control a fuel injection timing of each of said cylinders sequentially based on said standard position signal wherein said microprocessor is further programmed, when a terminal position of said engine is not stored in said memory or when an abnormal terminal position is stored, to control simultaneous injection of fuel into all cylinders on the first fuel injection timing after said engine is activated.

8. An activation control device as defined in claim 7 wherein said microprocessor is further programmed, after the first fuel injection, to control simultaneous injection of a smaller amount of fuel than on the first occasion fuel is injected into all cylinders on the first fuel injection timing after said engine is activated.

9. An activation control device as defined in claim 8 wherein said standard position signal contains a standard position signal showing a specific cylinder and said microprocessor is further programmed to terminate said activation control and to control fuel injection into each cylinder based on the ignition order of said cylinders when a standard position signal showing said specific cylinder is input.

* * * * *